US011696647B2

(12) United States Patent
Sun et al.

(10) Patent No.: US 11,696,647 B2
(45) Date of Patent: Jul. 11, 2023

(54) INTELLIGENTLY ADJUSTABLE SUPPORTING MODULE AND AUTOMATICALLY ADJUSTABLE BED

(71) Applicant: SHENZHEN ONETHIRD SLEEP TECHNOLOGY CO., LTD, Shenzhen (CN)

(72) Inventors: Chengjun Sun, Shenzhen (CN); Kuntao Lu, Shenzhen (CN); Zhong Liu, Shenzhen (CN); Yong Le, Shenzhen (CN); MingLiang Su, Shenzhen (CN)

(73) Assignee: SHENZHEN ONETHIRD SLEEP TECHNOLOGY CO., LTD, Shenzhen (CN)

( * ) Notice: Subject to any disclaimer, the term of this patent is extended or adjusted under 35 U.S.C. 154(b) by 196 days.

(21) Appl. No.: 17/254,860

(22) PCT Filed: Jun. 22, 2018

(86) PCT No.: PCT/CN2018/092479
§ 371 (c)(1),
(2) Date: Dec. 22, 2020

(87) PCT Pub. No.: WO2019/242017
PCT Pub. Date: Dec. 26, 2019

(65) Prior Publication Data

US 2021/0259429 A1 Aug. 26, 2021

(51) Int. Cl.
*A47C 19/04* (2006.01)
*A47C 27/20* (2006.01)

(52) U.S. Cl.
CPC ..... *A47C 19/045* (2013.01); *A47C 27/20* (2013.01)

(58) Field of Classification Search
CPC ..... A47C 19/045; A47C 27/20; F16F 1/24; F16F 1/024
USPC ..... 5/611
See application file for complete search history.

(56) References Cited

U.S. PATENT DOCUMENTS 2,194,569 A * 3/1940 Rumpf ..... A47C 27/20 5/717
9,119,478 B2 * 9/2015 DeFranks ..... A47C 27/06
10,588,420 B1 * 3/2020 Krenik ..... A47C 19/027
(Continued)

FOREIGN PATENT DOCUMENTS

CN 204931031 U * 9/2015 ..... A47C 27/00
CN 204931031 U 1/2016
(Continued)

OTHER PUBLICATIONS

International Search Report of PCT/CN2018/092479 published on Dec. 26, 2019.
Written opinion of PCT/CN2018/092479 published on Dec. 26, 2019.

*Primary Examiner* — David R Hare
*Assistant Examiner* — Luke Hall
(74) *Attorney, Agent, or Firm* — Menachem Nathan; Nathan & Associates

(57) ABSTRACT

A supporting module comprises a sensing spring, an outer spring and a sensor, wherein the sensing spring is slightly higher than the outer spring, the sensing spring is sleeved inside the outer spring, and the bottom of the sensing spring is connected to the sensor. An automatically adjustable bed, comprising the supporting module.

8 Claims, 6 Drawing Sheets

(56) References Cited

U.S. PATENT DOCUMENTS

| | | | | |
|---|---|---|---|---|
| 2004/0025258 | A1* | 2/2004 | Van Der Wurf | A47C 27/144 5/718 |
| 2006/0162087 | A1* | 7/2006 | Chang | A47C 27/20 5/724 |
| 2014/0208517 | A1* | 7/2014 | Gross | A47C 27/15 5/691 |
| 2016/0029811 | A1* | 2/2016 | Rawls-Meehan | A47C 7/027 5/729 |
| 2018/0199728 | A1* | 7/2018 | Leng | A47C 23/002 |
| 2021/0307534 | A1* | 10/2021 | Krenik | A47C 27/14 |

FOREIGN PATENT DOCUMENTS

| | | | | | |
|---|---|---|---|---|---|
| CN | 107928238 | A | | 4/2018 | |
| CN | 107997472 | A | * | 5/2018 | A47C 27/05 |
| CN | 107997472 | A | | 5/2018 | |
| WO | 2016171695 | A1 | | 10/2016 | |

* cited by examiner

INTELLIGENTLY ADJUSTABLE SUPPORTING MODULE AND AUTOMATICALLY ADJUSTABLE BED

CROSS REFERENCE TO RELATED APPLICATIONS

This application is a national entry application of International Application No. PCT/CN2018/092479 filed on Jun. 22, 2018, the entire contents of which are herein incorporated by reference in its entirety.

TECHNICAL FIELD

The present disclosure relates to the field of beds, in particular, to an intelligently adjustable supporting module and an automatically adjustable bed including the same.

TECHNICAL BACKGROUND

One third of a person's life is spent in sleep, and the sleep quality of people greatly affects their health conditions. Good sleep quality helps people take a full rest during sleep, recover the physical strength or recover from illness. Poor sleep quality would make people have poor rest and cause sub-health and other diseases. Good sleep can be obtained only by using high-quality beds. Under normal circumstances, the human spine has four bends which form an S shape from the side view, i.e., cervical lordosis, thoracic kyphosis, lumbar lordosis and sacral kyphosis. In other words, the shape of a human body has a certain curve. A good bed should be able to maintain the normal physiological curve of the human body to make people feel comfortable during sleep. At the same time, because of the fast pace of life nowadays, people usually have an extremely high pressure. Many people have certain health problems in their heads, necks, and shoulders. Supporting problems of these parts during sleep are particularly important.

Beds on the market now have many hidden health hazards. The beds on the marker can be divided into: hard bed, Simmons soft beds, skeleton beds, and other types of beds. None of the existing beds can be automatically adjusted according to different forces on the human curve, accordingly the beds need to be improved so in order to improve the sleep quality.

SUMMARY OF INVENTION

The present disclosure provides an intelligent adjustable supporting module and an automatic adjustable bed including the same, so as to solve the problem that an existing bed cannot be automatically adjusted to keep a human spine in a normal physiological curve.

The technical solution of the present disclosure is realized as follows: The embodiments of the present disclosure disclose an intelligent adjustable supporting module. The supporting module comprises an induction spring, an outer ring spring and a sensor. The induction spring is slightly higher than the outer ring spring, the induction spring is sleeved inside the outer ring spring, and the bottom portion of the induction spring is connected with the sensor, the outer ring spring is in no contact with the sensor, and at least one outer ring spring is provided.

Further, the supporting module further comprises a first limiting block arranged at the bottom portion of the induction spring, and a second limiting block arranged at the bottom portion of the outer ring spring, and the first and second limiting blocks are configured for avoiding the induction spring and the outer ring spring from moving in a horizontal direction under the action of an external force.

Further, the supporting module further comprises an induction plate, the induction plate is arranged at the top portion of the induction spring in such a way that the outer ring spring and the induction spring are separated.

Further, the induction plate comprises an induction plate body, a mounting slot formed in the middle portion of the induction plate body, and a protrusion arranged on an external circumference of the induction plate body, wherein the protrusion is configured for contacting the outer ring spring to stop the induction spring from being pressed to a bottommost position, the top portion of the mounting slot is provided with an inward bevel edge, and the mounting slot is used for mounting on one end portion of the induction spring.

Further, the induction plate is a cylindrical hollow surface cover which is made of a plastic material.

The intelligent adjustable supporting module provided by the present disclosure has the following beneficial effects: each sensor bears a pressure independently in a conduction process, and also has an effect of protecting the sensor and an inner ring spring. In addition, the inner ring spring and the outer ring spring are separated, so that when the inner ring spring is stressed by an extremely high pressure, the elastic force of the outer ring spring can be used, and the noise can be reduced.

The embodiments of the present disclosure disclose an automatic adjustable bed, including: a mattress, a plurality of the above-said supporting modules and a controller connected with the supporting modules. The intelligent adjustable supporting modules are arranged in the mattress. Each supporting module includes an induction spring, an outer ring spring and a sensor. The induction spring is slightly higher than the outer ring spring, the induction spring is arranged in the outer ring spring in a sleeved manner, and the bottom portion of the induction spring is connected with the sensor, the outer ring spring is in no contact with the sensor, and at least one outer ring spring is provided.

Further, the mattress is provided with through holes, the number of the through holes is the same as that of the supporting modules, each of the supporting modules are arranged in the corresponding through hole, and the top portions of the supporting modules are flush with an upper surface of the mattress.

Further, the supporting modules are transversely and longitudinally arranged, two adjacent intelligent adjustable supporting modules in a longitudinal direction are connected and fixed through a connection buckle, and four adjacent intelligent adjustable supporting modules in a transverse direction are connected through a connection ring and a connection buckle, and the connection rings are externally tangent with an outer ring of the top portion of the outer ring spring.

Further, the connection ring and the connection buckle are both made of stainless steel material or glass fiber-reinforced plastic material.

Further, the mattress is selected from the group consisting of a sponge mattress, a latex mattress or a memory foam mattress, and springs are arranged below the supporting modules.

The intelligent adjustable supporting module and the automatic adjustable bed including the same, which are provided by the present disclosure, have the following beneficial effects: the automatic adjustable bed provided by the present disclosure can overcome the defect that an ordinary bed cannot be automatically adjusted according to a sleeping posture of a human body and pressures on different parts of the human body, and solve the problem that an existing bed cannot keep a human spine in a normal physiological curve.

BRIEF DESCRIPTION OF THE DRAWINGS

To describe the embodiments of the present disclosure or the technical solutions in the existing art more clearly, drawings required to be used in the embodiments or the illustration of the existing art will be briefly introduced below. Obviously, the drawings in the illustration below are only some embodiments of the present disclosure. Those ordinarily skilled in the art also can acquire other drawings according to the provided drawings without doing creative work.

Figure 1:
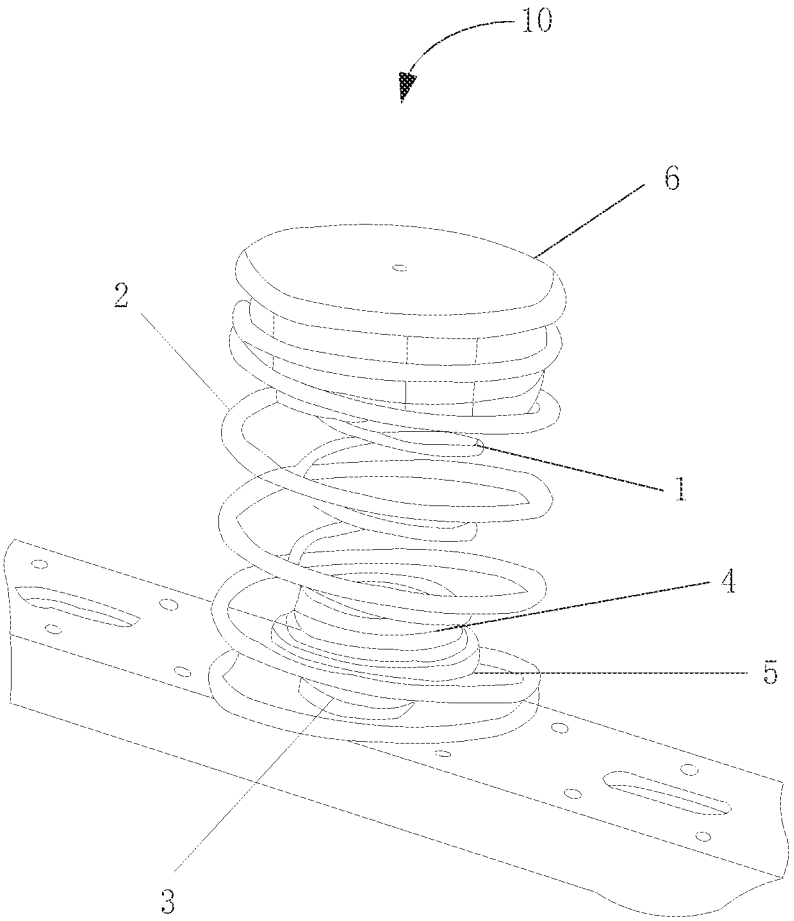
FIG. 1 is a schematic structural diagram of an intelligent adjustable supporting module of Embodiment I of the present disclosure.

In the drawings: 1: induction spring; 2: outer ring spring; 3: sensor; 4: first limiting block; 5: second limiting block; 6: induction plate; 10: supporting module; 20: mattress; 30: through hole; 40: connection ring; 50: connection buckle; 61: induction plate body; 62: mounting slot; 63: protrusion; 64: bevel edge; 65: round through hole; and 200: bed.

EMBODIMENTS

The present disclosure can be further understood through specific embodiments of the present disclosure provided. However, it should be understood that the specific embodiments are not used to limit the present disclosure. Some non-essential improvements and adjustments made by those skilled in the art based on the invention content are also deemed to fall within the protection scope of the present disclosure.

Referring to FIG. 1, an intelligent adjustable supporting module is illustrated. The supporting module 10 includes an induction spring 1, an outer ring spring 2, and a sensor 3. The induction spring 1 is slightly higher than the outer ring spring 2, the induction spring 1 is arranged in the outer ring spring 2 in a sleeved manner, and the bottom portion of the induction spring 1 is connected with the sensor 3, and the outer ring spring 2 is in no contact with the sensor 3, and at least one outer ring spring 2 is provided. The supporting module of the present disclosure can be used in an intelligent adjustable bed, an intelligent adjustable sofa, and the like, and can be arranged in a mattress. The induction spring 1 is used for detecting a pressure on a surface of the mattress or a sofa cushion, and transmitting the same to the sensor 3. The sensor 3 detects data related to the pressure and transmits the data to a data processor. The data processor can be connected with a controller (not shown in the figure), and the controller is used for controlling a supporting state of the mattress and an adjustable action for a bracket of the bed. Through the arrangement of the intelligent supporting module, humanized intelligent regulation for the intelligent adjustable bed can be realized.

In a preferred embodiment, the data processor and the controller are integrated together.

The sensor 3 is arranged on a fixed bracket of the bed, and is fixed relative to the bed and is usually disposed on the inner side of the bottom portion of the induction spring 1. In this way, the sensor can be protected, and data can be processed conveniently and more stably.

The thicknesses of the induction spring 1 and the outer ring spring 2 illustrated in FIG. 1 are different. In an actual application, the elastic coefficient of the spring can be adjusted, so as to achieve a main objective of intelligent adjustable of the present disclosure.

Referring to FIG. 1, the supporting module 10 further includes: a first limiting block 4 arranged at the bottom portion of the induction spring 1, and a second limiting block 5 arranged at the bottom portion of the outer ring spring 2. The limiting blocks are used for avoiding the induction spring 1 and the outer ring spring 2 from moving in a horizontal direction under the action of an external force. In an actual application, the two limiting blocks are fixed on the bracket of the bed, so as to relatively fix the two-spring structure and the bracket.

According to one embodiment of the present disclosure, the height of the induction spring 1 is greater than that of the outer ring spring 2. In this way, the induction spring 1 can better induce the pressure. At the same time, when the induction spring 1 is pressed, the outer ring spring 2 can be used to protect the induction spring.

Referring to FIG. 1, the supporting module 10 further includes an induction plate 6. The induction plate 6 is arranged at the top portion of the induction spring 1. Since the two-spring structure is arranged in the mattress, the induction plate covers the induction spring to make the top portion of the mattress smoother and improve the experienced comfortableness of a user.

Figure 2:
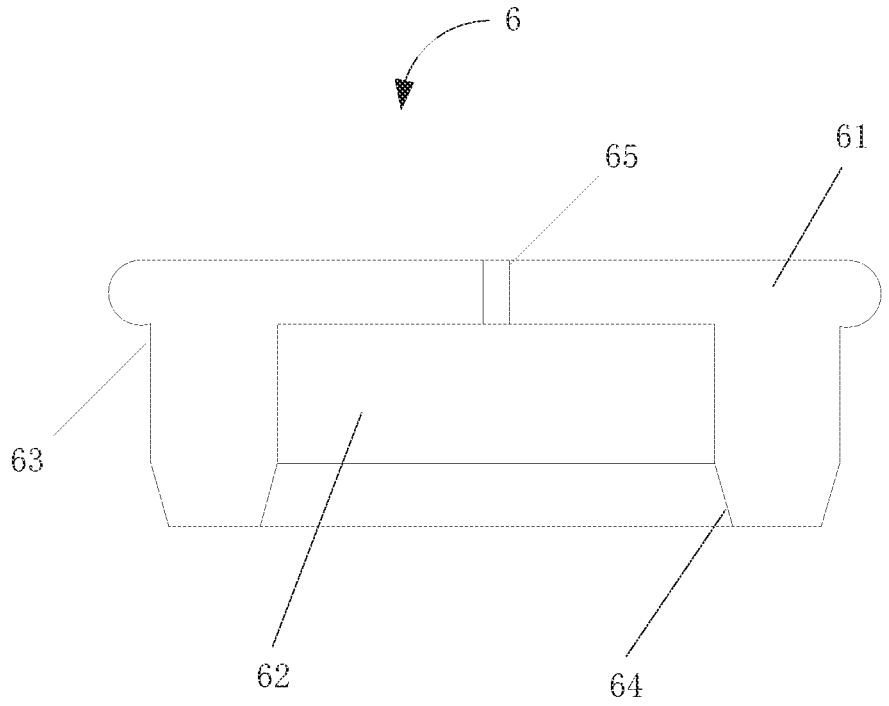
FIG. 2 is a schematic structural diagram of a middle portion of an intelligent adjustable supporting module of Embodiment I of the present disclosure.

Referring to FIG. 1 and FIG. 2, the whole induction plate 6 is of a bottle cover structure, and includes: an induction plate body 61, and a hollow mounting slot 62 arranged at the middle portion of the induction plate body 61. The mounting slot structure corresponds to an exterior outline of the top portion of the induction spring 1, and is used for mounting the upper end portion of the induction spring 1. The induction plate 6 also includes a protrusion 63 arranged on an exterior circumference of the induction plate body 61. The protrusion 63 is used for contacting the outer ring spring 2 to avoid the induction spring 1 from being pressed to a lowest position, so as to protect the induction spring and the sensor. An inner edge of the lower portion of the mounting slot 62 is provided with an inward bevel edge 64, and an outer edge is also provided with the same bevel edge. Such arrangement facilitates inserting the hollow drum-type structure of the induction plate 6 into a gap between the outer ring spring 2 and the induction spring 1, so as to facilitate fixing. Further, a round through hole 65 may be arranged in the center of the top portion of the induction plate 6. The round through hole 65 may be used for fixing the induction spring 1.

In one embodiment, the top end of the induction spring 1 is clamped into the induction plate 6.

In another embodiment, the round through hole 65 is a threaded hole, and the top end of the induction spring 1 is fixed below the induction plate 6 through a screw.

In particular, the whole induction plate 6 is made of a plastic material, preferably a POM (polyformaldehyde) plastic material. The induction plate 6 is fixed at the upper end portion of the induction spring 1, and may separate the induction spring 1 from the outer ring spring 2. When a pressure on the induction spring 1 is too high, the elastic force of the outer ring spring 2 may be used, moreover, since the POM plastic material is adopted, and the induction spring 1 and the outer ring spring 2 are separated, the two springs can be prevented from colliding with each other, and the noise is reduced.

According to the embodiments of the present disclosure, in a specific application, a plurality of the intelligent adjustable supporting modules would be used. Specifically, the outer ring spring 2 may be connected together with a mesh connection device. In a preferred embodiment, as shown in FIG. 5, the mesh connection device includes connection rings 40 and connection buckles 50.

The intelligent adjustable supporting module provided by the present disclosure has the following beneficial effects: Each sensor bears a pressure independently in a conduction process, and also has an effect of protecting the sensor and an inner ring spring. In addition, the inner ring spring and the outer ring spring are separated, so that when the inner ring spring is stressed by an extremely high pressure, the elastic force of the outer ring spring can be used, and the noise can be reduced.

Figure 3:
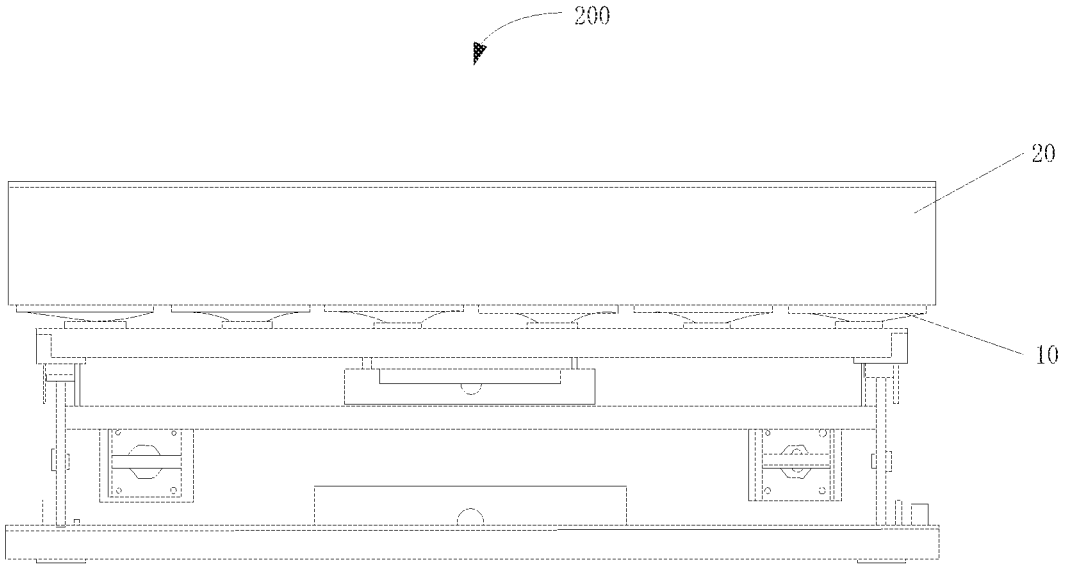
FIG. 3 is a schematic structural diagram of an automatic adjustable bed of Embodiment I of the present disclosure.

Referring to FIG. 3, an automatic adjustable bed 200 is illustrated, including: a mattress 20, several supporting modules 10 and a controller (not shown) connected with the supporting modules 10. As shown in the figure, the several supporting modules 10 are arranged in the mattress 20. Referring to FIG. 1 again, each supporting module 10 includes an induction spring 1, an outer ring spring 2, and a sensor 3. The induction spring 1 is slightly higher than the outer ring spring 2, the induction spring 1 is arranged in the outer ring spring 2 in a sleeved manner, and the bottom portion of the induction spring 1 is connected with the sensor 3, and the outer ring spring 2 is in no contact with the sensor 3, and one outer ring spring 2 is provided. In other embodiments, more than one outer ring spring 2 is disposed according to an actual requirement.

Figure 4:
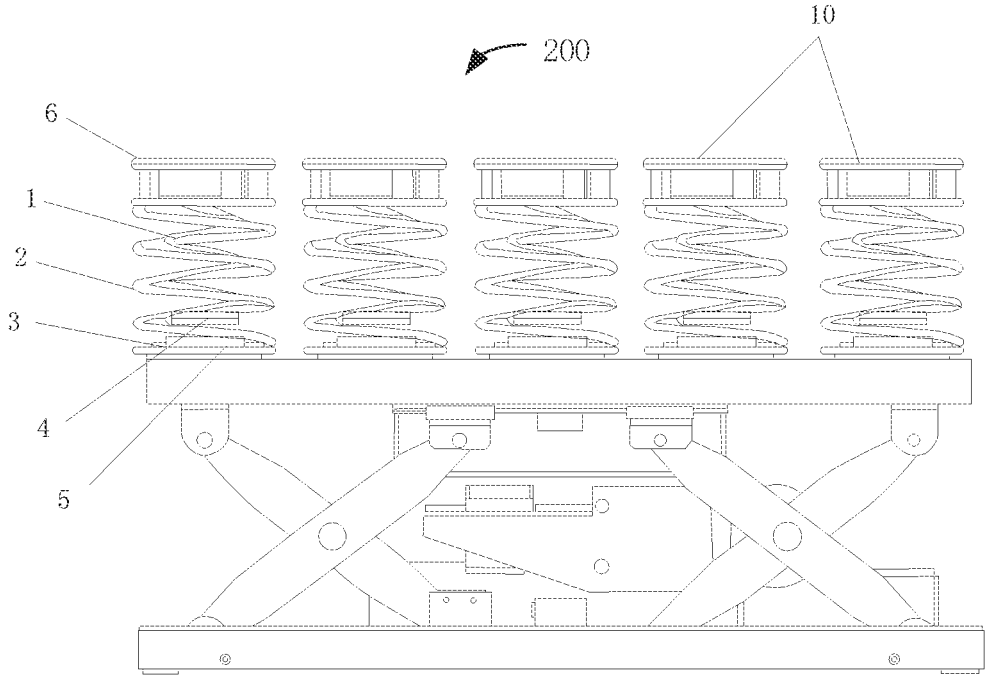
FIG. 4 is a schematic structural diagram of an automatic adjustable bed of Embodiment I of the present disclosure from another visual angle.
Figure 5:
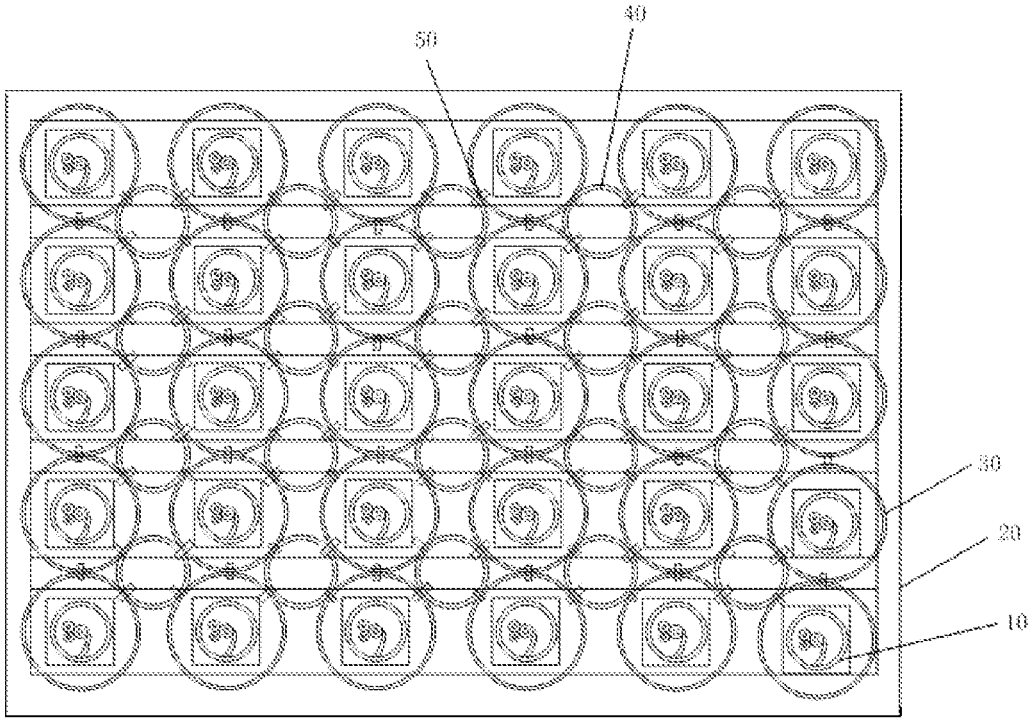
FIG. 5 is a schematic diagram of connection rings and connection buckles of an automatic adjustable bed of Embodiment 11 of the present disclosure.

Referring to FIG. 3, FIG. 4 and FIG. 5, according to the embodiments of the present disclosure, the mattress 20 is provided with through holes 30. The quantity of the through holes 30 is the same as the quantity of the supporting modules 10, the supporting modules 10 are arranged in the through holes 30, and the top portions of the supporting modules 10 are flush with an upper surface of the mattress 20. In this way, no bumpy feeling is generated during use.

Referring to FIG. 5, according to the embodiments of the present disclosure, a plurality of supporting modules 10 are arranged vertically and horizontally, and are arrayed into one row in a longitudinal direction. FIG. 5 illustrates that each row includes five supporting modules 10, and there are six rows of supporting modules in a transverse direction. Two adjacent supporting modules 10 in the longitudinal direction are connected and fixed through connection buckles 50, and four adjacent supporting modules 10 in the transverse direction are connected through the connection rings 40 and the connection buckles 50. The connection rings 40 are externally tangent with an outer ring of the top portion of the outer ring spring 2. The connection buckles 50 are used for connection and fixing between the outer ring springs 2 as well as between the connection rings 40 and the outer ring springs 2.

According to the embodiments of the present disclosure, referring to FIG. 5, the connection rings 40 and the connection buckles 50 are stainless steel materials, and may also be glass fiber-reinforced plastic materials at the same time.

According to the embodiments of the present disclosure, referring to FIG. 3, the mattress 20 is a sponge mattress or a latex mattress, and may also be a memory foam mattress.

In other embodiments, the mesh connection device may include other types of structures, such as an arc shape.

Preferably, springs may also be arranged below the supporting modules to make a spring mattress.

Preferably, the connection rings 40 and the connection buckles 50 are stainless steel materials. The connection rings 40 and the connection buckles 50 are arranged to connect the outer ring springs into a mesh. This arrangement has the effect that: The mattress 20 is usually locally stressed, but a specific part that bears a force is changeable, so that a single spring or a spring group may be damaged in case of excessive local stress. If the respective spring groups (the inner ring springs and the outer ring springs) are connected into a mesh, although the mattress is stressed directly by a pressure at each time, other spring groups would be involved, so that the single spring group can be protected.

In order to reduce the noise generated by spring pulling, filling materials may be added into spring gaps, such as sponge, latex and other soft materials.

In particular, the automatic adjustable bed also includes a bearing structure, which may include a supporting portion and a mechanical adjustable portion. The controller is connected with the mechanical adjustable portion, and the mechanical adjustable portion is slidably connected with the supporting portion, and the supporting portion is a whole, or is provided with a certain number of subregions. These subregions respectively correspond to specific parts of a human body, such as the head, the shoulders, the waist, the hip, the legs and the hands. The controller is used for detecting pressure parameters transmitted by the sensor, and determining, according to the pressure parameters, a real-time state of the automatic adjustable bed, and is used for driving the mechanical adjustable portion to act to adjust a height of a specified subregion of the supporting portion.

In one embodiment of the present disclosure, the controller includes a control chip and a specified number of subregion pressure detection units, subregion processing circuits and driving devices. The subregion pressure detection units are electrically connected with the subregion processing circuits and are used for detecting a human part pressure of each subregion, converting the pressure into an analog electrical signal and transmitting the same to the subregion processing circuit, the subregion processing circuits are electrically connected with the subregion pressure detection units, and are electrically connected with the control chip through 485 buses and used for filtering and amplifying the analog electric signals, converting the analog electric signals into required digital signals, and transmitting the digital signals to the control chip. The control chip is electrically connected with the subregion processing circuits and the driving devices and used for analyzing data of the subregion pressure detection units and controlling, according to a specified algorithm, the driving devices to act.

The driving devices are connected with the control chip and used to act according to an instruction of the control chip.

The present disclosure is further described below with reference to specific Examples:

Example I: The present embodiment is an improved solution of the present disclosure. Some mattresses in the existing designs use independent spring devices, but the inventor finds that when independent springs are used one by one, if springs that meet the requirements are disposed, the elastic coefficient of each spring may be relatively high, which will cause higher requirements for such aspects as wire diameters and a manufacturing process of the springs and higher cost. Therefore, this solution uses the structure of "spring in spring", as shown in FIG. 4, that is, there are two springs forming a spring group-a large spring (the outer ring spring 2) and a small spring (the induction spring 1). The diameter of the large spring is larger than that of a sensing panel. Each sensing panel is wrapped in the spring, and the sensing panel is in no contact with the large spring. In addition, the independent small spring is disposed on each sensing panel. The height of the small spring is slightly greater than the height of the large spring, so as to ensure that a human body is preferentially in contact with the small spring when lying on the mattress, thus achieving accurate sensing. In this way, it is equivalent that more springs are stressed, and the elastic coefficient of a single spring can be effectively reduced, thereby achieving the objective of reducing the cost and process requirements.

After the small spring is added in the middle, when the human body performs actions, such as turning over, on the mattress, the small spring is easy to bend left and right and in contact with the large spring outside, which will cause noise and affect sleep. To solve this problem, the inventor adds a round panel, i.e., the induction plate 6, on the top portion of the small spring, as shown in FIG. 4. It is placed between the small spring and the large spring. When the small spring swings left and right under the action of a non-vertical force, the round panel (the induction plate 6) will be in contact with the spring group. The round panel is made of POM or other plastic materials to ensure that no sound will be generated and affect sleep when the round panel is in contact with the spring group.

The spring in spring mechanical structure is basically similar to an ordinary mechanical structure in the working principle, but the spring in spring mechanical structure has a separate induction plate above each sensor. This allows each sensor to bear the pressure independently during the conduction, and also has a function of protecting the sensors and the inner ring springs.

The working principle of each group of spring in spring is: the induction plate 6 is connected with the induction spring 1. (Since the induction plate is of a stepped cylindrical shape, the induction plate cooperates with the outer ring spring 2 through an outer ring and can slide up and down) Under a pressure, the induction spring 1 goes down, and the sensor 3 receives the pressure and starts to analyze data. When the pressure is too high, the protrusion 63 of the induction plate 6 is in contact with an upper surface of the outer ring spring 2, and the outer ring spring 2 bears the pressure to avoid the induction spring 1 from being pressed to a bottommost position. Both the outer ring spring 2 and the induction spring 1 are provided with limiting blocks (the first limiting block 4 and the second limiting block 5), so that the springs can be avoided from moving when bearing the pressure.

Example II: For the technical solution of Example I, when a user stands and sits on the mattress, jumps on the mattress or do exercises on the mattress, if a stress area is smaller, there may be a phenomenon that all the stress acts on a few of springs below a stress bearing point, which results in spring damage or causes that the elastic coefficients of the springs need to be increased during the design, but a too large elastic coefficient would reduce the user experience. Therefore, in the present embodiment, the large springs (the outer ring springs 2) may be connected together through the mesh connection structure (the gaps of the longitudinally arranged outer ring springs 2 may be connected by the connection rings 40 and the connection buckles 50) to form a spring group, as shown in FIG. 5. In this way, when the human body is standing, sitting violently, or doing exercises, the phenomenon of a contact with two to three springs only is avoided, but the entire large spring group. Therefore, this is equivalent to connecting the entire group of large springs in parallel. If the whole achieves the same elastic coefficient, the elastic coefficient of a single large spring can be effectively reduced, so as to achieve the objectives of reducing the cost and process requirements.

A spring net formed by weaving the springs and steel rings is mounted above the module structure (springs and springs as well as springs and steel rings (the connection rings 40) are fastened by steel buckles), and the spring net can be just wrap the induction springs inside. Furthermore, the total height of the spring net is slightly lower than the induction springs, so that the influence of the spring net on sensing data can be ignored.

When the above modules 10 are placed into the mattress 20, as shown in FIG. 3, in order to maintain the overall softness and comfortableness of the mattress 20, sponge, latex or other soft materials can be added to fill the gaps between the adjacent outer ring springs 2 as well as between the outer ring springs 2 and the induction springs 1 in specific operations, so as to ensure better sleep. The specific operations are as follows:

Through holes 30 corresponding to the positions of the sensors 3 are cut on one whole piece of sponge, and the height of the sponge is equal to the total height of the induction springs 1. The sponge is then placed above a supporting structure. Each through hole 30 of the sponge is caused to wrap the induction spring 1 and the outer ring spring 2, so that the whole structure is neat and attractive. At the same time, when a person sleeps or does other actions on the mattress, it is ensured that the springs are in no contact with each other and cannot make sounds that affect the sleep.

Figure 6:
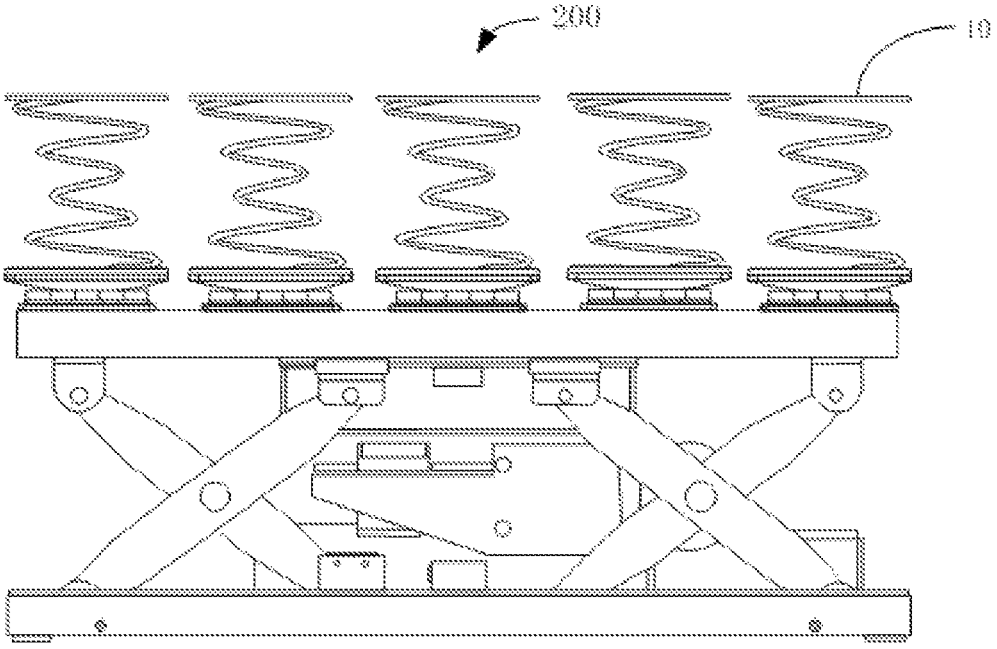
FIG. 6 is a schematic structural diagram of an automatic adjustable bed of Embodiment III of the present disclosure.

Example III: The present embodiment is the most basic spring mattress structure. The mattress of this embodiment is simple in process and relatively low in production cost. A hard supporting material surface is provided with independent springs, as shown in FIG. 6. Each spring is located on each sensing panel and connected with each sensor. The spring may be a tower spring, a straight spring or a spring having a wide mouth and a narrow body, or all types of the springs may be used. The elastic coefficient of the spring should not be too large because a too large elastic coefficient would cause the mattress to be too hard and cause sleep discomfort. At the same time, the elastic coefficient of the spring should not be too small. In case of a too small elastic coefficient, when standing or violently sitting on the mattress, the human body would have a feeling that the spring has shrunk to the bottom and been in contact with a hard substance, and this causes sleep discomfort. Therefore, the elastic coefficient and height of the springs here satisfy that when an ordinary adult (about 70 kg) stands on the mattress, the springs would not reach the limit of elasticity and shrink to the bottom, and better keep the human body not having the feeling of touching a hard substance. Different types of mattresses can also be set according to the weights of customers. For example, type I corresponds to users with regular weights, and type II corresponds to overweight users (for example, above 90 Kg), so that users can get the best experience.

In the present embodiment, as in Embodiment II, several through holes corresponding to the positions of the springs are cut on a whole piece of sponge, and sensors are arranged below the springs. The height of the sponge is equal to the total height of the springs. The sponge is then placed above a supporting structure. Each through hole of the sponge is caused to wrap the spring, so that the whole structure is neat and attractive. At the same time, when a person sleeps or does other actions on the mattress, it is ensured that the springs are in no contact with each other and cannot make sounds that affect the sleep.

The automatic adjustable bed provided by the present disclosure has the following beneficial effects: the defect that an ordinary bed cannot be automatically adjusted according to a sleeping posture of a human body and pressures on different parts of the human body is overcome, and the problem that an existing bed cannot keep a human spine in a normal physiological curve.

The above is only the preferred embodiments of the present invention, and is not intended to limit the present invention. Any modifications, equivalent replacements and improvements that are made within the spirit and principle of the present invention shall fall within the protection scope of the present invention.

What is claimed is:

1. An intelligent adjustable supporting module comprising an induction spring, an outer ring spring and a sensor, wherein the induction spring is slightly higher than the outer ring spring, the induction spring is sleeved inside the outer ring spring, the induction spring is connected with the sensor at a bottom portion, there is no contact between the outer ring spring and the sensor, and at least one outer ring spring is provided;

the intelligent adjustable supporting module further comprises an induction plate which is arranged at a top portion of the induction spring in such a way that the outer ring spring and the induction spring are separated;

the induction plate comprises an induction plate body, a mounting slot formed in a middle portion of the induction plate body, and a protrusion arranged on an external circumference of the induction plate body, wherein the protrusion is configured for contacting the outer ring spring so as to stop the induction spring from being pressed to a lowest position, the top portion of the mounting slot is provided with an inward bevel edge, and the mounting slot is configured for mounting on one end of the induction spring.

2. The intelligent adjustable supporting module of claim 1, wherein the intelligent adjustable supporting module further comprises a first limiting block arranged at the bottom portion of the induction spring, and a second limiting block arranged at a bottom portion of the outer ring spring, wherein the first and second limiting blocks are configured for avoiding the induction spring and the outer ring spring from moving in a horizontal direction under an action of an external force.

3. The intelligent adjustable supporting module of claim 1, wherein the induction plate is a cylindrical hollow cover made of plastic material.

4. An automatic adjustable bed comprising the intelligent adjustable supporting module of claim 1, wherein the automatic adjustable bed further comprises a mattress and a controller connected with the intelligent adjustable supporting module, and the intelligent adjustable supporting module is arranged in the mattress.

5. The automatic adjustable bed of claim 4, wherein the mattress is provided with through holes therein, there are a plurality of the intelligent adjustable supporting modules, the through holes have a number as same as that of the intelligent adjustable supporting modules, each intelligent adjustable supporting module is arranged in an corresponding through hole, and the intelligent adjustable supporting modules have top portions flush with an upper surface of the mattress.

6. The automatic adjustable bed of claim 4, wherein there are a plurality of intelligent adjustable supporting modules, and the intelligent adjustable supporting modules are transversely and longitudinally arranged, two adjacent intelligent adjustable supporting modules in a longitudinal direction are connected with each other and fixed together through a connection buckle, and four adjacent intelligent adjustable supporting modules in a transverse direction are connected through a connection ring and the connection buckle and the connection ring is externally tangent with an outer ring of the top portion of the outer ring spring.

7. The automatic adjustable bed of claim 6, wherein the connection ring and the connection buckle are both made of stainless steel material or glass fiber-reinforced plastic material.

8. The automatic adjustable bed of claim 4, wherein the mattress is selected from the group consisting of a sponge mattress, a latex mattress and a memory foam mattress.

* * * * *